US008807396B2

(12) United States Patent
Bodet et al.

(10) Patent No.: US 8,807,396 B2
(45) Date of Patent: Aug. 19, 2014

(54) TRIGGER DIFFUSER

(75) Inventors: Hervé Bodet, Verdun (FR); Dominique Fournet, Belleville sur Meuse (FR)

(73) Assignee: Lindal France SAS, Briey (FR)

( * ) Notice: Subject to any disclaimer, the term of this patent is extended or adjusted under 35 U.S.C. 154(b) by 0 days.

(21) Appl. No.: 13/636,561

(22) PCT Filed: Mar. 18, 2011

(86) PCT No.: PCT/EP2011/054120

§ 371 (c)(1),
(2), (4) Date: Sep. 21, 2012

(87) PCT Pub. No.: WO2011/117149

PCT Pub. Date: Sep. 29, 2011

(65) Prior Publication Data

US 2013/0001323 A1 Jan. 3, 2013

(30) Foreign Application Priority Data

Mar. 22, 2010 (FR) ..... 10 01118

(51) Int. Cl.
*B67B 1/00* (2006.01)
*B65D 83/00* (2006.01)

(52) U.S. Cl.
USPC ..... 222/153.11; 222/153.13; 222/402.11

(58) Field of Classification Search
USPC ..... 222/153.11, 153.01, 153.09, 153.13, 222/153.14, 383.1, 402.11, 402.13
See application file for complete search history.

(56) References Cited

U.S. PATENT DOCUMENTS

| | | | | |
|---|---|---|---|---|
| 4,441,633 | A * | 4/1984 | Bennett | 222/153.13 |
| 5,819,985 | A | 10/1998 | Brody | |
| 6,003,738 | A * | 12/1999 | Foster et al. | 222/384 |
| 6,286,723 | B1 * | 9/2001 | Sweeton et al. | 222/153.13 |
| 6,669,061 | B2 * | 12/2003 | Tada | 222/383.1 |

(Continued)

FOREIGN PATENT DOCUMENTS

| | | | |
|---|---|---|---|
| EP | 2 060 507 | A2 | 5/2009 |
| WO | 98/32677 | A1 | 7/1998 |
| WO | 2007/008375 | A2 | 1/2007 |
| WO | WO 2007017039 | A1 * | 2/2007 |

OTHER PUBLICATIONS

International Search Report for PCT/EP2011/054120, mailing date of Apr. 19, 2011.

*Primary Examiner* — Paul R Durand
*Assistant Examiner* — Benjamin R Shaw
(74) *Attorney, Agent, or Firm* — Westerman, Hattori, Daniels & Adrian, LLP

(57) ABSTRACT

A trigger diffuser to be secured to the neck of a vial provided with an outlet valve (31) provides for securing it on the vial, actuating the valve (31), a trigger (200) movable between a neutral position, in which the valve is not actuated, and a diffusion position, in which an actuation element is moved in the direction of the valve so as to actuate it, and an outlet channel for the transport out of the diffuser of the product coming out of the valve. In order to store the diffuser without the risk of accidentally actuating the trigger even after the first withdrawal, the diffuser includes a blocking element (304) movable between a blocking position, in which the trigger (200) is prevented from reaching the diffusion position, and a release position, in which the trigger can be moved from the neutral position to the diffusion position.

20 Claims, 4 Drawing Sheets

(56) References Cited

U.S. PATENT DOCUMENTS

Figure 1:
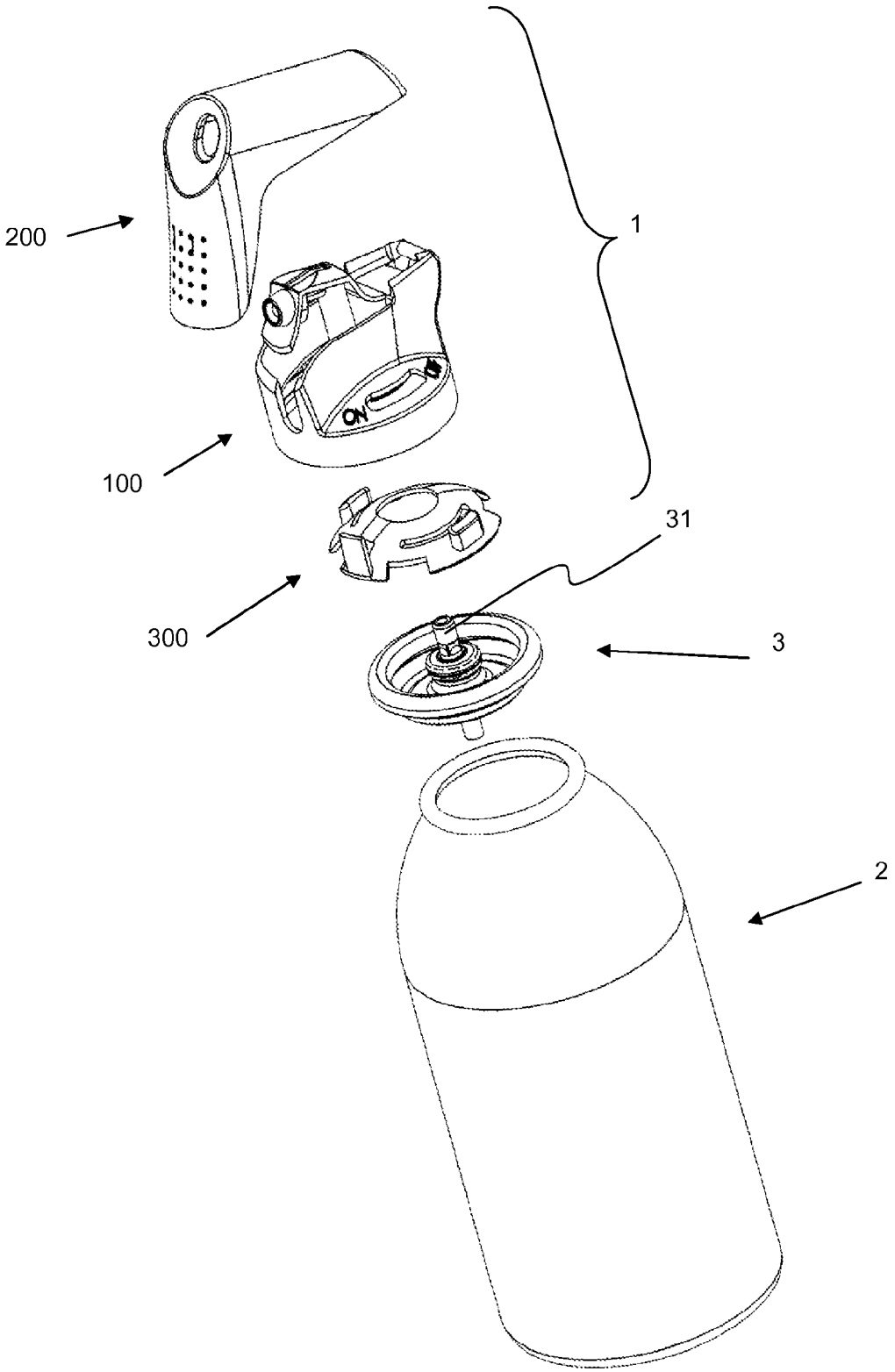

| | | | | |
|---|---|---|---|---|
| 6,758,373 | B2 * | 7/2004 | Jackson et al. | 222/153.11 |
| 7,017,785 | B2 * | 3/2006 | Lasserre et al. | 222/402.13 |
| 7,249,692 | B2 * | 7/2007 | Walters et al. | 222/153.11 |
| 2006/0113329 | A1 * | 6/2006 | Walters et al. | 222/383.1 |
| 2007/0119870 | A1 * | 5/2007 | Lasserre et al. | 222/321.8 |
| 2009/0127293 | A1 | 5/2009 | De Laforcade | |
| 2009/0145928 | A1 * | 6/2009 | De Laforcade | 222/153.11 |

* cited by examiner

300'
304
307
301
305
306
303
302

303
301
307
302
304
307
306

201
202
200'
203
205
204

100'

112
109
116
108
110a
107
110b
104
113
105
101
103
114

200'
205
116
1'
100'
300'
307

TRIGGER DIFFUSER

The invention relates to a trigger diffuser intended to be secured to the neck of a vial provided with an outlet valve. The diffuser comprises fastening means for securing it to the vial, actuation means for actuating the valve of the vial, a trigger movable between a neutral position, in which the actuation means do not actuate the valve, and a diffusion position, in which the actuation means are moved in the direction of the valve so as to actuate it, and an outlet channel for the transport out of the diffuser of the product coming out of the valve when the latter is actuated. In addition, the diffuser is provided with blocking means movable between a blocking position, in which they block the movement of the trigger so as to prevent it from reaching the diffusion position, and a release position, in which the trigger can be moved from the neutral position to the diffusion position. The trigger is provided with a rib oriented toward the center of the base and the blocking means are constituted by a vertical wall pivotable between a blocking position and a release position.

Such diffusers are commonly used in the food and cosmetics industries, in particular, for the diffusion of foam such as whipped cream.

It is important to avoid accidental actuation of the trigger causing an unintentional release of product, before the first use as well as afterwards.

Document WO 2007/008375 A2 describes a diffuser according to the preamble. This diffuser is composed essentially of a base screwed on the vial, a push button provided with means for actuating the valve and an outlet channel, a locking sleeve mounted pivotable around the base and the push button, a housing surrounding the base and the locking sleeve and on which a trigger is articulated. A rib is secured to the inner face of the trigger. The upper edge of the locking sleeve has two opposite vertices separated by two recesses. The rib of the trigger and the vertices of the sleeve are dimensioned so that when the vertices are located under the trigger, the lower edge of the rib abuts on the edge of the vertex located on the pivot side of the trigger. The latter cannot be pushed down and it cannot depress the push button. If the locking sleeve is rotated by a quarter turn, the recesses are now located under the trigger. If pressure is exerted on the free arm of the trigger, the latter pivots and moves down so as to press on the push button. The rib no longer abuts on the upper edge of the sleeve. This diffuser has several drawbacks. Firstly, it uses five separate pieces. Moreover, since the locking means are located on the pivot side of the trigger, it is necessary for the trigger to have sufficient thickness not to bend under the effect of pressure exerted on the free portion while the device is locked. If the thickness is insufficient, it will be possible to operate the push button even though the device is locked. This over-thickness of the trigger contributes to increasing manufacturing costs. In addition, to ensure locking, it is necessary for the edge of the rib to abut on the edge of the locking sleeve. Thus, the rib exerts a downwardly-oriented force parallel to the wall of the sleeve. A slight deformation of one or another of the pieces can result in that the required alignment is no longer ensured. The locking means would then become ineffective.

Document EP 2 060 507 A2 discloses a diffuser consisting of a base portion, a trigger articulated on the base, a push button articulated on the trigger and provided with means for actuating the valve and an outlet channel, blocking means being articulated on the base. These blocking means pivot about a vertical axis that is off-center relative to the diffuser as a whole. They include a vertical wall in a circular arc which can be selectively, either placed under the means for actuating the push button and thus block the downward movement or, on the contrary, moved away from them so that the actuation means can pass in front of the vertical wall and move down to actuate the valve. The trigger is thus blocked indirectly, via the push button which is articulated thereon. If too much pressure is exerted on the trigger, there is a risk that the flexible bridges connecting the push button to the trigger may yield, resulting in the destruction of the diffuser. In addition, since the locking means are connected to the base only by the pivot axis, they are at risk of shifting to an undesired position with the smallest jolt.

Document WO 98/32677 A1 discloses a trigger diffuser. It is provided with a base in the form of a gun, a trigger articulated on the base and intended to press on the push button of the vial on which the diffuser is mounted, a plate pivotable about a horizontal axis. The plate is provided with a slot into which the free end of the trigger can penetrate when the plate is lowered. In this case, the trigger cannot rotate and it cannot actuate the push button. If the plate is raised, the end of the trigger no longer cooperates with the slot of the plate. It is then possible to actuate the trigger. This device, which is already cumbersome by design, requires pulling out a plate in order to unlock the trigger.

The objective of the invention is therefore to provide a diffuser according to the preamble which is both compact and easier to carry. Another objective is to obtain a diffuser whose parts do not require a large amount of material. A third objective is to develop the blocking means so that they do not require high precision positioning and/or manufacturing.

This objective is achieved according to the invention in that, in the release position, the vertical wall is not aligned with the rib of the trigger, and in the blocking position, the wall is aligned with the rib of the trigger so as to block the movement of the latter toward the diffusion position. Thus, depending on the position of the wall with respect to the rib, it is possible to block or not block the movement of the trigger.

To avoid over-dimensioning the trigger in order to prevent it from being deformed if excessive pressure is exerted thereon while the wall is in the blocking position, it is preferable to secure the trigger to the diffuser by articulation means and to arrange the rib of the trigger opposite from the articulation means relative to the actuation means for actuating the valve.

To simplify the diffuser, the rib is preferably arranged on the trigger so that it bears on one of the two faces of the vertical wall so as to exert a force substantially orthogonal to the vertical wall when the wall is in the blocking position and the trigger is actuated. Even in the case of a deformation of the wall or of the rib, the blocking function continues to be ensured because the rib does not bear on the upper edge of the wall as in the state of the art, but on its main surface.

In practice, the diffuser can be constituted by a base provided with the fastening means, the actuation means and the outlet channel, and on which the trigger is articulated. This makes it possible to reduce the number of parts required for manufacturing the diffuser.

Preferably, the trigger has substantially the shape of an upside down L constituted by a first arm, called articulated arm, whose end is provided with articulation means for articulating it on the base, and a second branch, called free arm. In this case, it is possible to place the rib on the face of the free arm oriented toward the center of the diffuser.

Preferably, the vertical wall is secured to a pivoting shield. This shield is placed inside the base and it is provided with at least one lug projecting through a slot in a circular arc formed in the base so that the lug or lugs are accessible from outside the base. It is thus possible for the user to pivot the shield, and with it, the vertical wall, by moving the lug or lugs in their respective slots. Unlike in the state of the art, the vertical wall in this case is located within the base, protected from external shocks.

To retain the shield within the base, it is preferable to provide at least one hook on the inside face of the base and at least one slot in a circular arc in the shield, the hook or hooks projecting into the slot or slots so as to hold the shield. The shield is held vertically by the hooks, without being blocked in rotation.

To avoid a deformation of the shield if excessive pressure is exerted on the vertical wall orthogonally thereto, it is possible to provide reinforcements on the shield, preferably on its lower face.

In a preferred embodiment of the invention, the trigger is secured to the base by a pivot. In addition, means may be provided to prevent the trigger from rising beyond the neutral position.

Figure 2A:
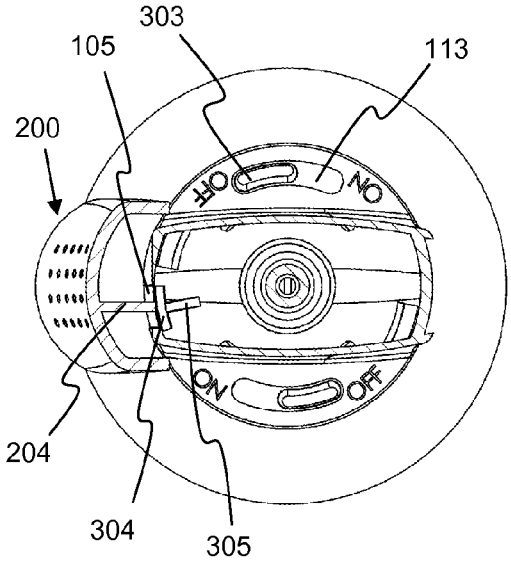
Figure 2B:
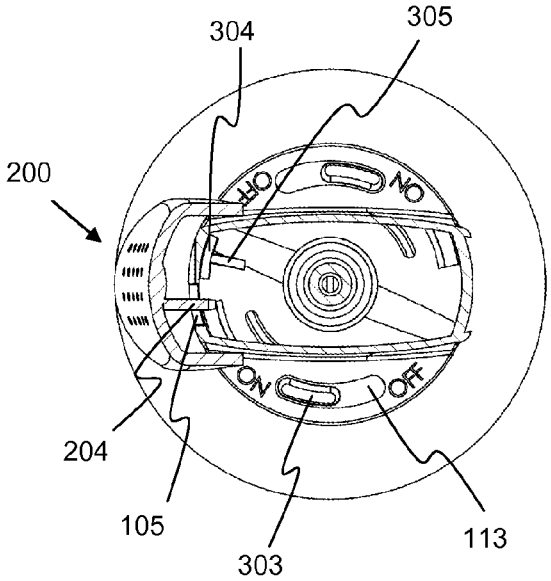
Figure 4A:
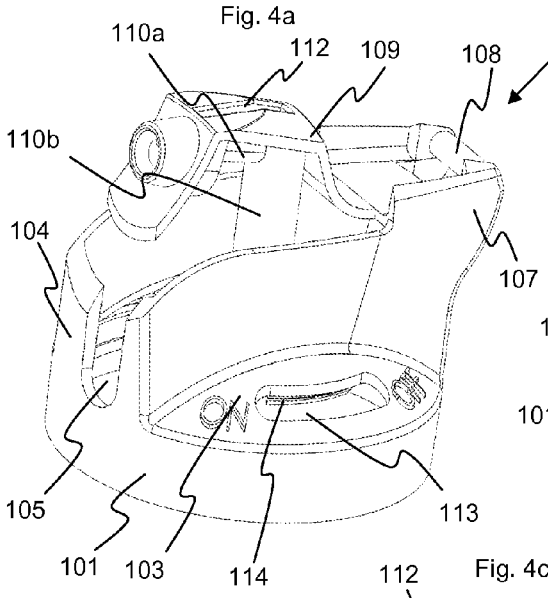
Figure 4B:
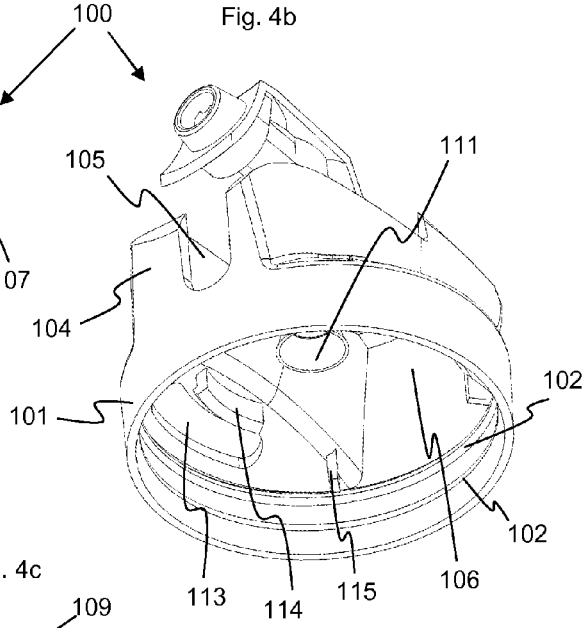
Figure 4C:
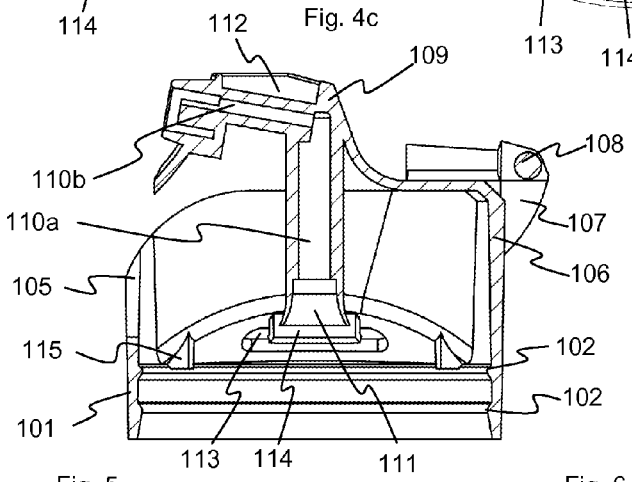
Figure 5:
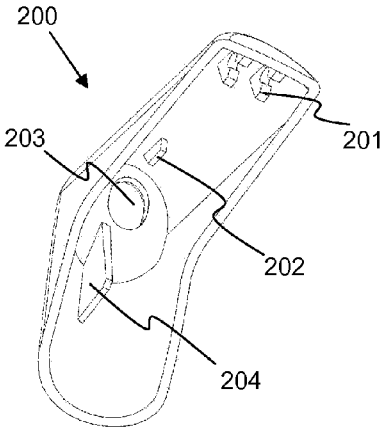
Figure 6:
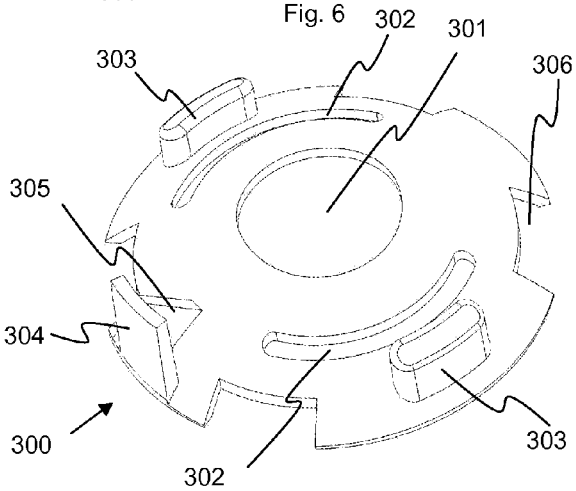
Figure 7:
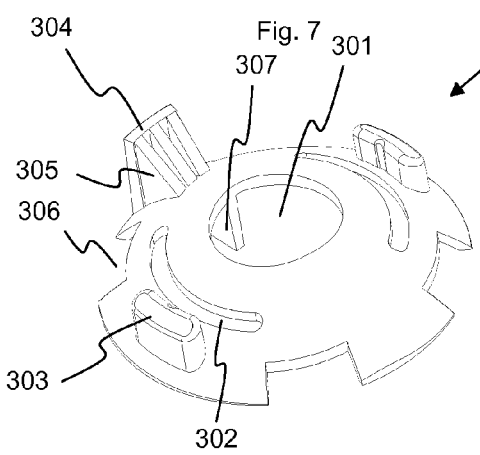
Figure 8:
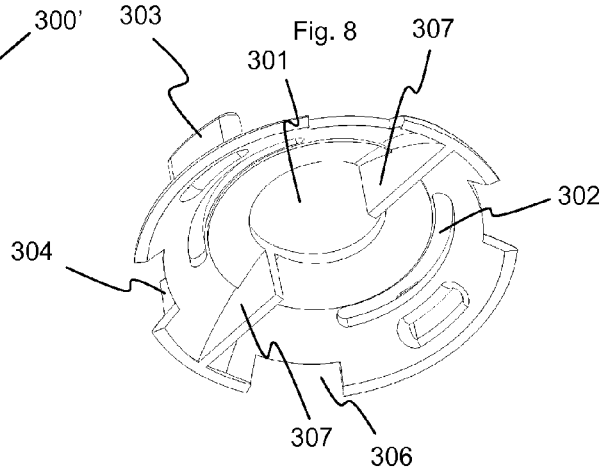
Figure 9:
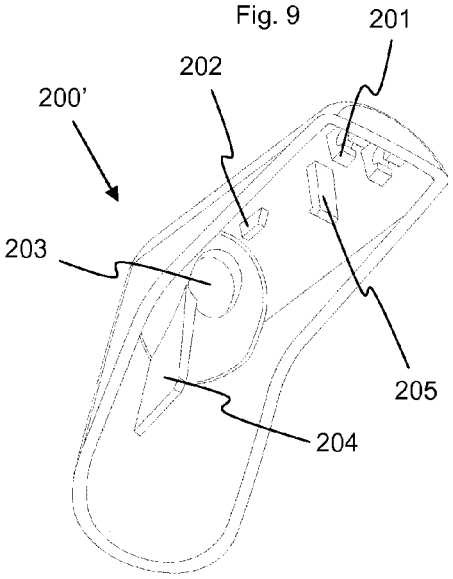
Figure 10:
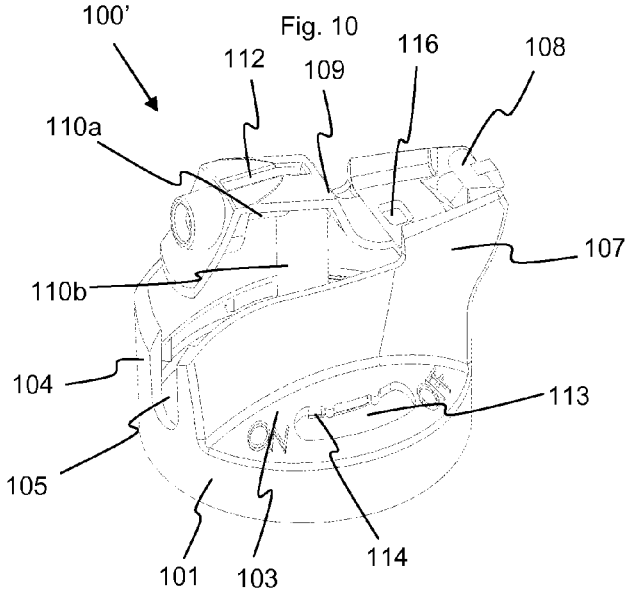

The invention is explained in more detail with reference to the following figures:

FIG. 1: exploded view of the various parts;

FIG. 2: horizontal cross-sectional view (a) with the blocking means in blocking position and (b) with the blocking means in release position;

FIG. 3: vertical cross-sectional view (a) with the blocking means in blocking position and (b) with the blocking means in release position;

FIG. 4: view of the base (a) in perspective from above, (b) in perspective from below, and (c) in cross-section;

FIG. 5: perspective view of the trigger;

FIG. 6: perspective view of the shield;

FIG. 7: perspective view from above of a second embodiment of shield;

FIG. 8: perspective view from below of the shield of FIG. 7;

FIG. 9: perspective view of a second embodiment of the trigger;

FIG. 10: perspective view of a second embodiment of the base; and

Figure 11:
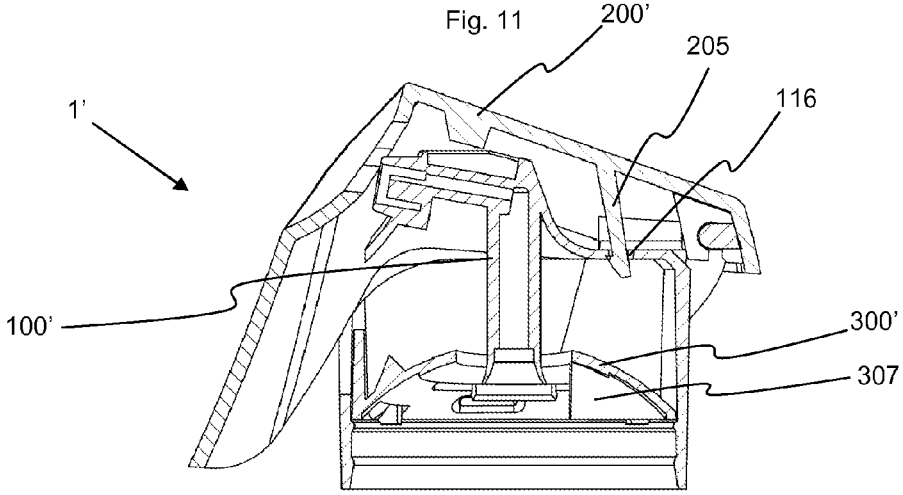

FIG. 11: cross-sectional view of a diffuser provided with a shield according to FIG. 7, a trigger according to FIG. 9 and a base according to FIG. 10.

For clarity, the description uses spatial references such as "lower" and "upper." It should be noted that the diffuser is manufactured and sold independently of the vial and that the protection covers in particular the diffuser alone, without a vial. Therefore, these references are made with respect to the diffuser as it is intended to be used, assembled with a vial whose diffuser is placed above the vial. This does not prevent the diffuser from being used in an inverted position, that is to say, with the diffuser under the vial, or in any other position.

The diffuser (1, 1') of the invention is essentially constituted by a base (100, 100'), a trigger (200, 200') articulated on the base (100, 100') by articulation means, and a shield (300, 300') located inside the base (100, 100'). It is designed to snap onto the neck of a vial (2) provided with a valve (31), while remaining movable in rotation.

In the embodiments presented herein, the vial (2) is a housing having a pointed-dome-shaped neck. It is closed by a cup (3) provided with a valve (31) of the male type. The content of the vial is pressurized. When the valve (31) is depressed, it opens and the product is released. Of course, the valve can be a valve of the female type, the actuation means being modified accordingly. Similarly, the invention is not limited to pressurized vials. The valve can be a valve closing a piston pump, for example.

The base (100, 100') has a circular skirt (101) designed to snap onto the neck of the vial (2). Hereinafter, the axis of rotational symmetry of the skirt is referred to as the axis of symmetry. To this effect, the skirt (101) is provided with fastening means (102) placed on its inner face and made in the form of two ridges. The distance separating these two ridges corresponds to the thickness of the mounting seam of the cup (3) set on the vial neck (2). Thus, once snapped on this setting seam, the diffuser cannot move vertically.

Above the skirt, the wall of the base is extended by two shoulders (103) which are symmetrical so that the cross-section of the base above these shoulders approaches the shape of a rectangle with its two small sides in circular arcs. In one of these small sides (104), a U-shaped aperture (105), open at the top, has been formed. In the vicinity of the other small side (106), in the extension of each longitudinal side, two flanges (107) have been placed, which are parallel to the radial plane and between which a horizontal pivot (108) perpendicular to the flanges (107) is located.

The base (100, 100') is extended on the side of the flanges (107) by a substantially horizontal wall from which a tongue (109) extends. The outlet channel (110*a*, 110*b*) for the product coming from the valve (31) is located on the lower face of this tongue (109). This channel is divided into a vertical section (110*b*) which is aligned with the axis of symmetry and ends at the bottom with the actuation means (111) for cooperating with the valve (31), and a section (110*a*) which is closer to the horizontal, opens to the outside, and ends with a nozzle if appropriate. A guide groove (112) is formed on the upper face of the tongue (109). This tongue is sufficiently flexible so that it is possible to press it so as to cause a downward movement of the outlet channel (110*a*, 110*b*) and the actuation means (111).

On each shoulder (103), a slot (113) in a circular arc has been provided, the center of the circle being located on the axis of symmetry. In the vicinity of each slot (113), a hook (114) has been placed on the inside face. These hooks are designed to hold the shield (300, 300').

On the inner side of the base, reinforcing ribs (115) are arranged at the base of the shoulders (103).

The trigger (200, 200') has substantially the shape of an upside-down L constituted by a first arm, called articulated arm, and a second arm, called free arm. At the end of the articulated arm opposite the free arm, two hooks (201) have been placed on the inner face for latching onto the pivot axis (108) of the base (100, 100'). Thanks to the lateral sides of the trigger, it is possible to hide the pivot and the hooks. These hooks (201) and the pivot axis (108) form articulation means. On the same face, closer to the free arm, a guide rib (202) has been placed. This rib is positioned such that, when pressure is exerted on the free arm in the direction of the vial, the articulated arm comes to press on the tongue (109) and the guide rib (202) penetrates into the guide groove (112) of the tongue.

In the vicinity of the intersection between the two arms, an opening (203) has been provided on the free arm. This opening is dimensioned and positioned such that it is aligned with the outlet end of the channel (110*a*). Thus, then the valve is actuated, the product exiting the channel (110*a*, 110*b*) passes through this opening (203). It is possible to expel the product, not in a jet inclined with respect to the vertical, but in a jet along the axis of symmetry. To this effect, the outlet channel can be limited to its vertical portion (110*a*), and the opening (203) can be moved onto the articulated arm.

On the inner side of the free arm, a second rib (204) has been placed. This rib is positioned such that it penetrates without difficulty into the U-shaped opening (105) of the base when pressure is exerted on the free arm of the trigger (200, 200'). This rib (204) is parallel to the radial plane but does not pass through the axis of symmetry. The cross-sectional views of FIGS. 3*a* and 3*b* pass through this rib (204), which is offset relative to the channel (110*a*, 110*b*), for example.

Inside the base (100, 100'), a shield (300, 300') is provided to hold the means for blocking the trigger (200, 200'). This shield (300, 300') has substantially the shape of a circular dome. It is provided with a central opening (301) to let the vertical section (110*b*) of the channel and the actuation means (111) pass through. It is also provided with two slots (302) in circular arcs. These slots are dimensioned and positioned such that the hooks (114) of the base can penetrate and remain stuck therein.

The shield carries on its upper side two lugs (303) which are dimensioned and arranged such that they penetrate into the slots (113) in circular arcs of the base and project toward the outside face of the base. These lugs (303) allow the user to pivot the shield between two end positions limited by the abutment of the lugs (303) on the ends of the slots (113) and/or of the hooks (114) on the ends of the slots (302).

Further, the shield (300, 300') carries on its upper face a substantially vertical wall (304) located in the extension of the periphery of the shield. This wall constitutes the means for blocking the trigger. It is supported by one or more radial reinforcements (305). In the example shown, the vertical wall (304) has a curved shape in the extension of the circumference of the shield. It could also be made planar. This wall pivots between two end positions at the same time as the shield. Like the shield, the wall is located inside the base, protected from external shocks. In a first position, called blocking position, the wall comes to close the U-shaped opening (105) of the base. In the other end position, called release position, the wall has pivoted sufficiently to free the U-shaped opening (105).

Four recesses (306) are formed on the periphery of the shield to allow the shield to pass through in the area of the reinforcements (115).

The principle of operation of the diffuser of the invention is described below in reference to FIGS. 2 and 3. In FIGS. 2*a* and 3*a*, the shield (300) is rotated in the blocking position. The lugs (303) abut on the right end of the slots (113) of the base. The wall (304) obstructs the opening (105) of the base. The trigger (200) cannot be depressed, being blocked by the rib (204) which comes to abut on the wall (304) while the articulated arm of the trigger (200) does not press (or does not sufficiently press) on the tongue (109) to cause the valve (31) to open. It is observed that the rib (204) comes to abut against the outer vertical face of the vertical wall (304) while exerting a force substantially horizontal and directed toward the inside of the diffuser. This force is thus substantially orthogonal to the vertical wall. The wall is sufficiently wide so that it is not necessary to provide a very accurate adjustment of the position of the rib (204) relative to the U-shaped opening (105).

If the user rotates the shield (300, 300') by moving the lugs (303) that protrude from the slots (113) toward the left, until they come to abut against the other end of the slots (113), the wall (304) pivots sufficiently to free the U-shaped opening (105). The rib (204) can now enter this opening (105) and the trigger can pivot sufficiently about the pivot (108) for the articulated arm to come and press on the tongue (109) so as to push it down in the direction of the valve. The actuation means (111) then come into contact with the valve (31) and depress it, causing it to open. When the pressure exerted on the free arm of the trigger stops, the valve (31) pushes the actuation means back up, and with them, the channel and the tongue (109). This in turn pushes the articulated arm of the trigger back up, thus moving the free arm away. The rib (204) comes back out of the slot (105) and the shield (300, 300') can be moved back into the blocking position if necessary.

Figure 3A:
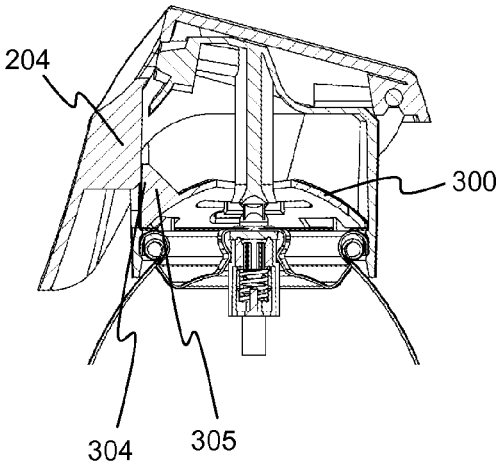
Figure 3B:
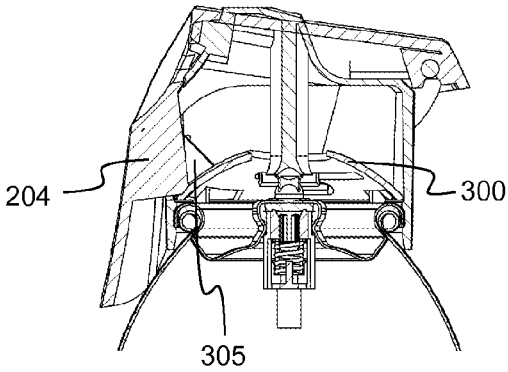

It should be noted that in the view 3*b*, the tongue (109) with the channel (110*a*, 110*b*) and the actuation means (111) are shown incorrectly in the non-depressed position (as shown in FIG. 3*a*). In fact, the arm that connects the tongue (109) to the rest of the body of the base is flexible enough to allow for the tongue to be depressed.

In an alternative embodiment shown in FIGS. 7-11, some improvements have been made to the basic model. Each improvement is independent of the other, so it is not required to retain all of them.

Additional reinforcements (307) have been provided under the shield (300'). These reinforcements are in the form of two vertical ribs, one of which is placed under the vertical wall (304) and the other opposite therefrom. These ribs are dimensioned such that when the diffuser (1') is placed on a container (2), they come to bear on the cup (3). Thus, even if very high pressure is exerted by the rib (204) on the vertical wall (304), the latter cannot yield by pivoting backward and by deforming the shield downward.

Similarly, three reinforcements (305) have been provided behind the vertical wall (304), thus allowing the rib (204) to bear on the entire surface of the vertical wall without deformation of the latter.

In order to prevent the trigger (200') from rising beyond the neutral position, retaining means have been provided. These retaining means are constituted by, on the one hand, a hook (205) disposed on the lower face of the articulated arm, in the vicinity of the articulation means. A corresponding slot (116) has been formed in the tongue (109) of the base. After assembly of the trigger on the base, the trigger is pushed down toward the base and the hook (205) passes through the slot (116). If pressure is exerted on the free arm of the trigger, the hook (205) moves down within the base without interfering with the pivotal movement of the trigger. Conversely, if the user tries to raise the trigger, the trigger is retained by the hook which comes to abut against the edge of the slot (116). Unless by forcing the hook until it is destroyed, in principle, the user does not have access to the valve (31) and does not risk soiling it.

Thanks to the rib being located, not on the articulated arm, but on the free arm, it is possible to block the movement of the trigger by having the rib abut, not on the upper edge of the wall, but on its vertical face. Thus, cooperation between the rib (204) and the wall (304) is guaranteed even in the event of a deformation of one or another of the pieces. Moreover, an exact fit of the pieces relative to one another is not required, unlike with the blocking means proposed by the state of the art.

In addition, by placing the blocking means opposite from the pivot (108) relative to the contact point between the trigger and the tongue (109) carrying the actuation means (111), it is not necessary to over-dimension the trigger. Indeed, even if excessive pressure is exerted on the free arm while the vertical wall is aligned with the rib, the trigger will not be deformed as it bears on one side on the pivot (108) and on the other side on the vertical wall.

Rather than a pivot axis, it is also possible to secure the trigger to the base by a film hinge. To this effect, the base and the hinge can be manufactured by injection in one piece, for example. The hinge can also be overmolded on a previously injection-molded base, or vice versa. The film hinge performs the function of articulation means.

LIST OF REFERENCES

| | | | |
|---|---|---|---|
| 1 | Diffuser | 1' | Diffuser |
| 100 | Base | 100' | Base |
| 101 | Skirt | | |
| 102 | Ridges (fastening means) | | |
| 103 | Shoulders | | |
| 104 | First rounded wall | | |
| 105 | U-shaped slot | | |
| 106 | Second rounded wall | | |
| 107 | Flanges | | |
| 108 | Pivot | | |
| 109 | Tongue | | |
| 110 | Outlet channel | | |
| 110a | Section close to the horizontal | | |
| 110b | Vertical section | | |
| 111 | Means for actuating the valve | | |
| 112 | Guide groove | | |
| 113 | Slot for the lugs | | |
| 114 | Hooks for fastening the shield | | |
| 115 | Reinforcements | | |
| | | 116 | Retaining slot |
| 200 | Trigger | 200' | Trigger |
| 201 | Fastening hooks on the pivot | | |
| 202 | Guide rib | | |
| 203 | Passageway opening | | |
| 204 | Rib (blocking means) | | |
| | | 205 | Hook |
| 300 | Shield | 300' | Shield |
| 301 | Central opening | | |
| 302 | Slot for the hooks of the base | | |
| 303 | Lugs | | |
| 304 | Wall (blocking means) | | |
| 305 | Reinforcement | | |
| 306 | Recesses | | |
| | | 307 | Reinforcement |
| 2 | Vial | | |
| 3 | Cup | | |
| 31 | Valve | | |

The invention claimed is:

1. Trigger diffuser intended to be secured to the neck of a vial provided with an outlet valve, comprising a base provided with fastening means for securing the diffuser to the vial;

actuation means for actuating the valve of the vial;

a trigger movable between a neutral position, in which the actuation means do not actuate the valve, and a diffusion position, in which the actuation means are moved in the direction of the valve so as to actuate it;

an outlet channel for the transport out of the diffuser of the product coming out of the valve when the valve is actuated; and blocking means movable between a blocking position, in which they block the movement of the trigger so as to prevent the trigger from reaching the diffusion position, and a release position, in which the trigger can be moved from the neutral position to the diffusion position;

the trigger being provided with a rib extending from the trigger substantially along a direction of movement of the rib when the trigger moves from the neutral position to the diffusion position; and the blocking means being constituted by a wall extending in a direction substantially orthogonal to the direction of movement of the rib when the trigger moves from the neutral position to the diffusion position, said wall being pivotable between a blocking position and a release position, wherein the rib is disposed on the trigger so that the rib bears on a face of the wall so as to exert a force substantially orthogonal to the wall when the transverse wall is in the blocked position and the trigger is actuated, and wherein, in the release position, the wall is not aligned with the rib of the trigger, and in the blocking position, the wall is aligned with the rib of the trigger so as to block the movement of the trigger toward the diffusion position.

2. Diffuser according to claim 1, wherein the trigger is secured to the diffuser by articulation means;

the rib of the trigger is disposed opposite from the articulation means (relative to the actuation means for actuating the valve.

3. Diffuser according to claim 1, wherein the base is provided with the fastening means, the actuation means and the outlet channel, and the trigger is articulated on the base.

4. Diffuser according to claim 1, wherein the trigger has substantially the shape of an upside down L constituted by a first arm, called articulated arm, wherein an end of the articulated arm is provided with articulation means for articulating the articulated arm on the base, and a second arm, called free arm.

5. Diffuser according to claim 4, wherein the rib is placed on the face of the free arm oriented toward the center of the diffuser.

6. Diffuser according to claim 1, wherein the wall is secured to a pivotable shield.

7. Diffuser according to claim 6, wherein the shield is placed inside the base and is provided with at least one lug projecting through a slot in a circular arc formed in the base so that the lug or lugs are accessible from outside of the base.

8. Diffuser according to claim 6, wherein at least one hook is provided on the inner face of the base and at least one slot in a circular arc is provided in the shield, the hook or hooks projecting into the slot or slots so as to hold the shield.

9. Diffuser according to claim 6, wherein reinforcements are provided on the shield to prevent the shield from being deformed if excessive pressure is exerted on the wall orthogonally thereto.

10. Diffuser according to claim 3, wherein the trigger is secured to the base by a pivot.

11. Diffuser according to claim 1, wherein means are provided to prevent the trigger from rising beyond the neutral position.

12. Diffuser according to claim 2, wherein the base is provided with the fastening means, the actuation means and the outlet channel, and the trigger is articulated on the base.

13. Diffuser according to claim 2, wherein the trigger has substantially the shape of an upside down L constituted by a first arm, called articulated arm, wherein an end of the articulated arm is provided with articulation means for articulating the articulated arm on the base, and a second arm, called free arm.

14. Diffuser according to claim 13, wherein the rib is placed on the face of the free arm oriented toward the center of the diffuser.

15. Diffuser according to claim 7, wherein at least one hook is provided on the inner face of the base and at least one slot in a circular arc is provided in the shield, the hook or hooks projecting into the slot or slots so as to hold the shield.

16. Diffuser according to claim 7, wherein reinforcements are provided on the shield to prevent the shield from being deformed if excessive pressure is exerted on the wall orthogonally thereto.

17. Diffuser according to claim 8, wherein reinforcements are provided on the shield to prevent the shield from being deformed if excessive pressure is exerted on the wall orthogonally thereto.

18. Trigger diffuser intended to be secured to the neck of a vial provided with an outlet valve, comprising a base provided with fastening means for securing the diffuser to the vial;

actuation means for actuating the valve of the vial;

a trigger movable between a neutral position, in which the actuation means do not actuate the valve, and a diffusion position, in which the actuation means are moved in the direction of the valve so as to actuate it;

an outlet channel for the transport out of the diffuser of the product coming out of the valve when the valve is actuated; and blocking means movable between a blocking position, in which they block the movement of the trigger so as to prevent the trigger from reaching the diffusion position, and a release position, in which the trigger can be moved from the neutral position to the diffusion position;

the trigger being provided with a rib extending from the trigger substantially along a direction of movement of the rib when the trigger moves from the neutral position to the diffusion position; and the blocking means being constituted by a wall extending in a direction substantially orthogonal to the direction of movement of the rib when the trigger moves from the neutral position to the diffusion position, said wall being pivotable between a blocking position and a release position, wherein, in the release position, the wall is not aligned with the rib of the trigger, and in the blocking position, the wall is aligned with the rib of the trigger so as to block the movement of the trigger toward the diffusion position, wherein the trigger has substantially the shape of an upside down L constituted by a first arm, called articulated arm, wherein an end of the articulated arm is provided with articulation means for articulating the articulated arm on the base, and a second arm, called free arm.

19. Diffuser according to claim 18, wherein the rib is placed on the face of the free arm oriented toward the center of the diffuser.

20. Trigger diffuser intended to be secured to the neck of a vial provided with an outlet valve, comprising a base provided with fastening means for securing the diffuser to the vial;

actuation means for actuating the valve of the vial;

a trigger movable between a neutral position, in which the actuation means do not actuate the valve, and a diffusion position, in which the actuation means are moved in the direction of the valve so as to actuate it;

an outlet channel for the transport out of the diffuser of the product coming out of the valve when the valve is actuated; and blocking means movable between a blocking position, in which they block the movement of the trigger so as to prevent the trigger from reaching the diffusion position, and a release position, in which the trigger can be moved from the neutral position to the diffusion position;

the trigger being provided with a rib extending from the trigger substantially along a direction of movement of the rib when the trigger moves from the neutral position to the diffusion position; and the blocking means being constituted by a wall extending in a direction substantially orthogonal to the direction of movement of the rib when the trigger moves from the neutral position to the diffusion position, said wall being pivotable between a blocking position and a release position, wherein, in the release position, the wall is not aligned with the rib of the trigger, and in the blocking position, the wall is aligned with the rib of the trigger so as to block the movement of the trigger toward the diffusion position, wherein the wall is secured to a pivotable shield placed inside the base and provided with at least one lug projecting through a slot in a circular arc formed in the base so that the lug or lugs are accessible from outside of the base.

* * * * *